United States Patent [19]

Aubert

[11] Patent Number: 4,774,487

[45] Date of Patent: Sep. 27, 1988

[54] SOLENOIDAL MAGNET WITH HIGH MAGNETIC FIELD HOMOGENEITY

[75] Inventor: Guy Aubert, Grenoble, France

[73] Assignee: Thomson-CGR, Paris, France

[21] Appl. No.: 939,124

[22] PCT Filed: Feb. 21, 1986

[86] PCT No.: PCT/FR86/00057

§ 371 Date: Nov. 14, 1986

§ 102(e) Date: Nov. 14, 1986

[87] PCT Pub. No.: WO86/05624

PCT Pub. Date: Sep. 25, 1986

[30] Foreign Application Priority Data

Mar. 19, 1985 [FR] France ..... 85 04050

[51] Int. Cl.[4] ..... H01F 5/00

[52] U.S. Cl. ..... 335/299; 336/227; 324/318; 335/296

[58] Field of Search ..... 335/299, 296; 336/227, 336/232; 324/318, 319, 320, 321

[56] References Cited

U.S. PATENT DOCUMENTS 3,227,930 1/1966 Hnilicka ..... 335/299 X

FOREIGN PATENT DOCUMENTS 1290248 3/1969 Fed. Rep. of Germany ..... 335/299

OTHER PUBLICATIONS

Journal of Physics E: Scientific Instruments, vol. 6, No. 4, Apr. 1973, London, GB, C. B. Wheeler et al: "Multiply Crowbarred Solenoids for Plasma Research", pp. 332–338.

*Primary Examiner*—George Harris

*Attorney, Agent, or Firm*—Oblon, Fisher, Spivak, McClelland & Maier

[57] ABSTRACT

A structure is provided for connection between spaced Bitter coils in a magnet with homogeneous field. The magnet is formed of several Bitter coils spaced apart from each other and two adjacent coils are connected together by two groups of conductors symmetrical with respect to a plane and in which the current components create ampere turns in opposition.

8 Claims, 2 Drawing Sheets

FIG_2
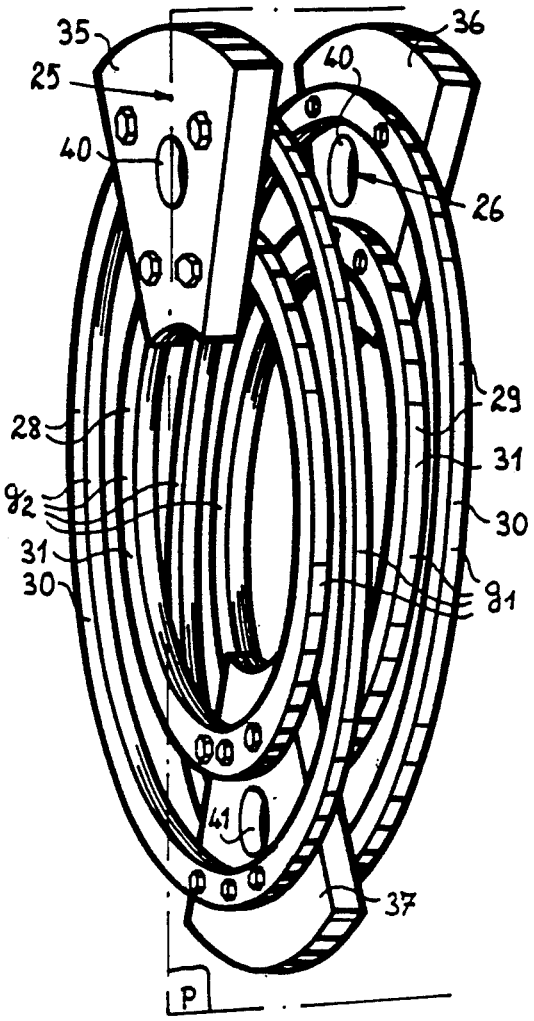
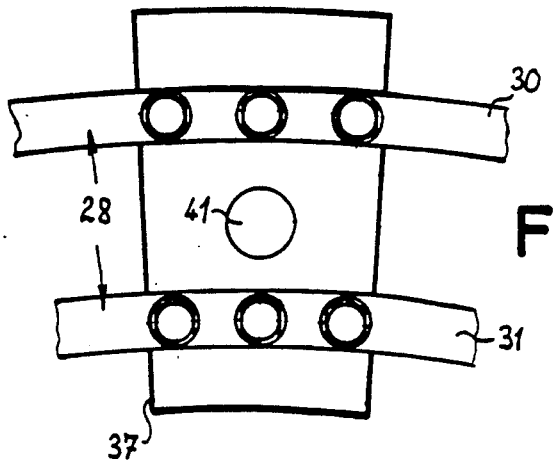
FIG_3

SOLENOIDAL MAGNET WITH HIGH MAGNETIC FIELD HOMOGENEITY

BACKGROUND OF THE INVENTION

1. Field of the Invention

The invention, due to the collaboration of the National Intense Field Service of the CNRS(director M. AUBERT) generally relates to a solenoidal magnet with high magnetic field homogeneity, formed of several coils spaced apart from each other; it relates more particularly to a structure for connection between the coils, avoiding the creation of parasite field components.

It is known that NMR image forming installations require a large sized magnet capable of generating a uniform magnetic field in a given region of space. Typically, it is necessary to generate a magnetic field of 0.15 to 0.5 teslas with a homogeneity of 1 to 10 parts per million (ppm) in a sphere of a diameter of 40 cm at least.

2. Description of the Prior Art

It is known to form such a magnet from an assembly of coils spaced apart from each other at chosen distances, along a common axis. In another patent application, the applicant describes a method for calculating the characteristics of such a magnet formed of coils all having the same inner and outer diameters and formed more particularly of Bitter type coils. In calculating such a magnet, it is assumed that no current flowing through the spaces between the coils is capable of creating a magnetic field. Now, the coils are connected together in series and connecting conductors necessarily pass through these spaces. The invention relates more specifically to a structure for connection between coils, arranged so as to avoid the formation of parasite field components between said coils.

SUMMARY OF THE INVENTION

In this spirit, the invention relates to a solenoidal magnet with high magnetic field homogeneity, formed of an assembly of coils of the same inner and outer diameters, spaced apart from each other by chosen distances along a common axis, said coils being connected in series, wherein two adjacent coils are connected together by groups of conductors symmetrical with respect to a plane passing through said axis and the ends of said adjacent coils so that the current components perpendicular to said axis in said groups of conductors create ampere turns in opposition, at every point of the space between said coils.

In a specific embodiment, two groups of above mentioned conductors are given material form by one or more circular conducting rings, each group thus having the ring part situated on each side of said plane. This or (preferably) these rings are arranged substantially transversely to the axis while being slightly deformed so as to define, each one, two substantially helicoidal and opposite half turns. Furthermore, this or these rings are connected to the ends of said coils on the one hand and/or together on the other by successively diametrically opposite junctions. In other words, if a single ring is used (case of relatively small spacing between two adjacent coils) it is connected to the two ends of the two adjacent coils at diametrically opposite points. If, on the other hand, several rings are used connected end to end for passing through the space between two coils, then the first ring is connected to one coil end at a first point and to an adjacent ring at a second diametrically opposite point and so on until connection of the last ring with the end of the other coil.

With the above described structure, it may be estimated as a first approximation that the magnetic field components generated by the currents which flow in the groups of conductors such as defined above cancel each other out mutually. There remains a longitudinal component of the current directed along the common axis of the coils, which depends more especially on the helical pitch of the connecting conductors. This current component is always small (especially if the number of rings connected end to end is increased) and creates little field. If the circumstances so require, it may also be offset by using the current return to the power supply source, that is to say by causing this return current to pass through at least each space between two coils, through at least one current return conductor shaped and/or disposed so as to distribute its flow substantially regularly and longitudinally over a cylindrical surface coaxial to said axis.

Furthermore, Bitter coils are well known for the production of intense magnetic fields. The structure proposed by Bitter is a coil formed of annular metal disks (generally made from copper or aluminium), split so as to form as many turns and connected together so as to define a substantially helical winding with flat turns. The stack of disks is held by a plurality of tie rods. This structure is advantageous for it allows efficient cooling of the magnet, by forming holes in the disks (and in the insulators separating these disks), these holes being disposed in the same configuration from one disk to another so as to form an assembly of channels parallel to the axis of the coil, in which a cooling fluid flows, for example deionized water, kerosene or oil.

The invention applies preferably to a magnet constructed from such Bitter coils to the extent that, more particularly, some at least of said tie rods may be used for forming the current return conductors distributing this current over a substantially cylindrical surface coaxial with said coils, as stated above.

BRIEF SUMMARY OF THE DRAWINGS

The invention will be better understood and other features thereof will be clearer from the following description of one embodiment of a magnet constructed in accordance with its principle, given solely by way of example, with reference to the accompanying drawings in which:

FIG. 2 is a partial perspective view of such a system of conductors; and

FIG. 3 is a detailed view of a junction point of the conductor system of FIG. 2.

DESCRIPTION OF THE PREFERRED EMBODIMENT OF THE INVENTION

Figure 1:
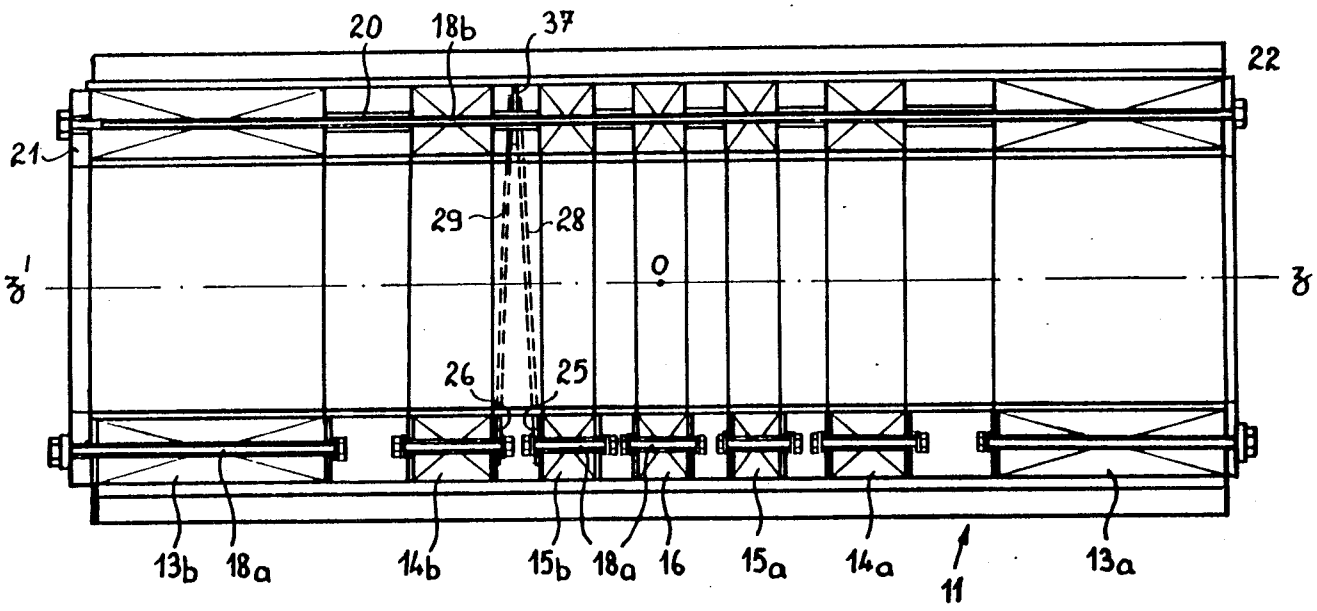
FIG. 1 is a general sectional view showing schematically a magnet formed of several Bitter type coils separated from each other by chosen distances and connected together by systems of conductors in a accordance with the invention.

Referring to the drawings a solenoidal magnet 11 is shown with annular Bitter disks, known per se, formed of several coils 13*a*, 14*a*, 15*a*, 16, 13*b*, 14*b*, 15*b* aligned along the same main axis of symmetry z'z. For application to NMR image formation, it is possible to obtain a magnetic field of required homogeneity in a sphere of interest of sufficient volume whose center O merges with that of the magnet, by choosing the lengths of the coils and the spacing between these coils. Moreover, the magnet is symmetrical with respect to a transverse plane passing through O. One possible method of calculating the characteristics of the coils of the magnet and the spacing between these coils is given in another French patent application No. 84 19191, filed by the applicant, which forms no part of the presently described invention.

By Bitter coil is meant any coil answering the above recalled definition. For this reason, the radially split disks forming the turns are connected, for example welded, end to end and are held in a tight stack by means of a plurality of tie rods 18*a* or 18*b* distributed evenly over a cylindrical surface with axis z'z. All the coils are connected together in series. The current source, not shown, is for example connected to the external end of coil 13*a*. The tie rods 18*a* are in several sections proper to each coil; they do not extend into the spaces defined therebetween. The tie rods 18*b* extend over the whole length of the magnet and are therefore common to all the coils. They are used on the one hand for holding in position insulated rigid tubes 20, forming spacers, for fixing the distances between the coils (the lengths of the spacers determining the desired spacing between coils) and on the other hand for bringing the current back to the current source, i.e. towards the external end of coil 13*a*. A current distribution plate 21, situated at the external end of coil 13*b*, provides substantially uniform distribution of the flow of the return current between the tie rods 18*b* which are evenly spaced apart, as mentioned above, over a cylindrical surface with axis z'z. Another distribution plate 22, isolated from coil 13*a* is placed at the end of the magnet the closest to the current source. This plate is also in electrical contact with the tie rods 18*b* so that this arrangement defines a sort of squirrel cage connected in series as a whole with the coils of the magnet, the tie rods 18*b* having flowing therethrough substantially equal fractions of the total current flowing through the coils. Of course, it is not indispensable to use the tie rods of the Bitter coils for compensating for the axial component of the current. If such compensation is desired, a simple cylindrical tubular envelope may be used external to the coils and coaxial, so as to provide the current return. A "squirrel cage" may also be used defined from conducting rods other than the tie rods.

According to an essential characteristic of the invention, the electrical connection between any two adjacent coils is provided by two groups $g_1$, $g_2$ of conductors symmetrical with respect to a plane P passing through the axis Z'Z and the ends 25, 26 of the adjacent coils (see FIG. 2). Such a connection structure is only illustrated between the coils 15*b* and 14*b* of FIG. 1. In the example specifically described, each mentioned group of conductors is formed by the halves of two circular conducting rings 28, 29 situated respectively on the same side of plane P. In addition, each ring 28 or 29 is formed of several (for example 2) concentric circular conductors 30 and 31 fixed by any suitable means to connecting pieces, 35 36, 37. The ring 28 is fixed to the end 25 of coil 15*b* by a metal connecting piece 35. Ring 29 is fixed to the end of 26 of coil 14*b* by a similar metal connecting piece 36. The rings 28 and 29 are connected together by a metal connecting piece 37 diametrically opposite the pieces 35 and 36. Two tie rods 18*a* situated in plane P and belonging respectively to the two coils to be connected together are used for fixing the connecting pieces 35 and 36 to the ends of these coils (assembly holes 40). Furthermore, one of the tie rods 18*b* with its spacer passes through the connecting piece 37 (hole 41). The other tie rods 18*b* pass between the two concentric conductors 30 and 31 of each ring. These latter have a rectangular section and are screwed and/or welded to the different connecting pieces (see FIGS. 2 and 3). As shown in FIGS. 1 and 2, when such an arrangement is in position between two coils, the connecting rings 28 and 29 are disposed substantially transversely to the axis while being slightly deformed longitudinally so as to define, each one, two approximately helical and opposite half turns symmetrical with respect to plane P. Consequently, on leaving the coil 15*b* considered, the current is divided equally between the two half turns and the current components flowing in the two half turns of the same ring create ampere turns in opposition, in every point of the space between the coils. Substantially no axial magnetic field is then generated by the collecting system between the coils. Furthermore, as mentioned above, the axial current component, however small it is, may be fairly accurately compensated for by the current return tie rods. Of course, the invention is not limited to the embodiment specifically described of the connecting structure. In particular, in the case where the coils of the magnet are effectively Bitter coils, it may be advantageous to form the conducting rings 28, 29 from the same annular Bitter disks used for manufacturing the coils, not split and connected end to end at diametrically opposite points. Furthermore, the number of rings used in a given space between two coils will depend on the length of this space.

What is claimed is:

1. A solenoidal magnet with high magnetic field homogeneity, formed of an assembly of coils of the same inner and outer diameters, spaced apart from each other by chosen distances along a common axis, said coils being connected in series, wherein two adjacent coils are connected together by two groups of conductors symmetrical with respect to a plane passing through said axis and the ends of said adjacent coils, so that the current components perpendicular to said axis in said groups of conductors create ampere-turns in opposition at every point of the space between said coils.

2. A solenoidal magnet as claimed in claim 1 wherein said two groups of conductors are given material form by at least one circular conducting ring arranged substantially transversely to the axis while being slightly deformed so as to define, each one, two substantially helical opposite half turns and said at least one ring are connected to the ends of said coils being at least one of together and on successively diametrically opposite junctions, each group thus including the ring parts situated on the same side of said plane.

3. The solenoidal magnet as claimed in claim 1 or 2, having at least one current return conductor at least one thereof being shaped and disposed so as to distribute the flow of said current return substantially evenly over a cylindrical surface coaxial with said axis in at least each space between two coils.

4. The solenoidal magnet as claimed in claim 3, further including several longitudinal rods distributed evenly over said cylindrical surface and said rods are connected together so as to define a sort of squirrel cage, this cage being connected in series as a whole with said coils so that said rods have flowing therethrough substantially equal fractions of the total current which flows through said coils.

5. The solenoidal magnet as claimed in claim 4, wherein said coils are Bitter type coils, formed by stacks, with interpositioning of insulators, of annular conducting disks each having a cut so as to form a turn and further including tie rods holding the stacks of disks in position and said rods are formed by tie rods common to all the coils.

6. The solenoidal magnet as claimed in claim 5, wherein said tie rods forming said rods are surrounded by insulated rigid tubes forming spacers, in said spaces between adjacent coils, the lengths of these spacers determining the desired spacing between coils.

7. The solenoidal magnet as claimed in claim 2, wherein each said conducting ring is formed of several concentric circular conductors.

8. The solenoidal magnet as claimed in claim 2, wherein said coils are coils of the Bitter type and said conducting rings connecting two adjacent coils together are formed by annular non split Bitter disks similar to the disks of said coils.

* * * * *